US009165516B2

(12) United States Patent
Fujioka et al.

(10) Patent No.: US 9,165,516 B2
(45) Date of Patent: Oct. 20, 2015

(54) DISPLAY DEVICE AND DRIVE METHOD THEREFOR

(71) Applicant: Sharp Kabushiki Kaisha, Osaka-shi, Osaka (JP)

(72) Inventors: Akizumi Fujioka, Osaka (JP); Kazuki Takahashi, Osaka (JP); Taketoshi Nakano, Osaka (JP); Toshihiro Yanagi, Osaka (JP); Yoshinori Shibata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/373,983

(22) PCT Filed: Feb. 1, 2013

(86) PCT No.: PCT/JP2013/052350
§ 371 (c)(1),
(2) Date: Jul. 23, 2014

(87) PCT Pub. No.: WO2013/118651
PCT Pub. Date: Aug. 15, 2013

(65) Prior Publication Data

US 2015/0109273 A1 Apr. 23, 2015

(30) Foreign Application Priority Data

Feb. 10, 2012 (JP) ..... 2012-027816

(51) Int. Cl.
*G09G 5/00* (2006.01)
*G09G 3/36* (2006.01)

(52) U.S. Cl.
CPC ..... *G09G 3/3614* (2013.01); *G09G 3/3648* (2013.01); *G09G 3/3688* (2013.01); *G09G 2300/0823* (2013.01); *G09G 2310/061* (2013.01)

(58) Field of Classification Search
None
See application file for complete search history.

(56) References Cited

U.S. PATENT DOCUMENTS

2002/0093473 A1 7/2002 Tanaka et al.
2011/0050553 A1 3/2011 Takada et al.
2013/0314361 A1 * 11/2013 Saitoh et al. ..... 345/173

FOREIGN PATENT DOCUMENTS

JP 2002-278523 A 9/2002
JP 2011-048057 A 3/2011
WO WO 2012137800 A1 * 10/2012

OTHER PUBLICATIONS

Official Communication issued in International Patent Application No. PCT/JP2013/052350, mailed on Apr. 9, 2013.

* cited by examiner

*Primary Examiner* — Adam R Giesy
(74) *Attorney, Agent, or Firm* — Keating & Bennett, LLP

(57) ABSTRACT

A polarity of a POL outputted from a polarity inversion control section (9) is always identical between a scanning period and a pause period immediately subsequent to the scanning period, and is reversed every time switching from a pause period to a scanning period is carried out. This makes it possible to both carry out pause driving and prevent image sticking on a display panel.

5 Claims, 6 Drawing Sheets

DISPLAY DEVICE AND DRIVE METHOD THEREFOR

TECHNICAL FIELD

The present invention relates to a display device which carries out reverse polarity driving, and a method for driving the display device.

BACKGROUND ART

Conventionally, a liquid crystal display device has been mounted in a wide variety of electronic devices. Due to having advantages such as small thickness, light weight, and low power consumption, the liquid crystal display device is expected to be utilized further in the future.

The liquid crystal display device has a problem of having image sticking on a display panel when DC driven. In general, in order to prevent the image sticking, the liquid crystal display device is driven by means of reverse polarity driving. According to the reverse polarity driving, a polarity of image data (data signal) written into each pixel constituting the display panel is reversed every frame. This causes a polarity of a voltage applied to liquid crystal in the each pixel to be reversed every frame as well, so that a polarity of an electric charge in liquid crystal is prevented from being positive more often than negative, and vice versa, while the display device operates. This allows preventing image sticking on the display panel.

On the other hand, in recent years, display devices of various kinds share a common issue of how to reduce power consumption. Pause driving has been proposed as a technique for solving the issue. A display device that carries out the pause driving does not scan a display panel in a certain number of consecutive frames following a frame in which the display device scans the display panel. In this pause period, voltages applied to pixels of the display panel in a frame immediately preceding the pause period are retained, so that what has been displayed is maintained as well. Since display in the pause period is carried out without a process of supplying a signal to the display panel, a reduction in power consumption is achieved.

CITATION LIST

Patent Literature

Patent Literature 1

Japanese Patent Application Publication, Tokukai, No. 2011-48057 A (Publication Date: Mar. 10, 2011)

SUMMARY OF INVENTION

Technical Problem

However, simply applying the pause driving to a liquid crystal display device that carries out the reverse polarity driving may sometimes cause image sticking on the display panel. This problem is discussed below with reference to FIG. 6.

FIG. 6 is a view illustrating a polarity of a voltage applied to liquid crystal in each frame when a conventional liquid crystal display device carries out the pause driving. In an example illustrated in FIG. 6, the number of frames in a scanning signal is four and the number of frames in a pause period is also four. That is, a sum of the number of frames constituting a scanning period and the number of frames constituting a pause period is an even number. A scanning period and a pause period are alternated.

In each scanning period, a polarity of a data signal is reversed every frame. Accordingly, a polarity of a voltage applied to liquid crystal is also reversed every frame. In the case where a sum of the number of frames constituting a scanning period and the number of frames constituting a pause period is an even number, a voltage applied to liquid crystal in the last frame in each scanning period has the same polarity as that of a voltage applied to liquid crystal in the last frame in another scanning period. In the example illustrated in FIG. 6, all of the voltages applied to liquid crystal in the last frames in the respective scanning periods have a positive polarity. In a conventional liquid crystal display device that carries out the pause driving, a voltage applied to liquid crystal in a pixel in the last frame in a scanning period immediately preceding each pause period is retained in the pixel in the each pause period. This is due to an effect of a capacitance component which is present in each pixel. As a result, voltages applied to liquid crystal in any pause periods are identical to each other in the example illustrated in FIG. 6. In the example illustrated in FIG. 6, all of the voltages applied to liquid crystal in the respective pause periods are negative.

Consequently, in a conventional liquid crystal display device that carries out driving as illustrated in FIG. 6, an electric charge in liquid crystal gradually becomes negative more often than positive while the liquid crystal display device operates. This becomes more prominent as a pause period becomes longer. A conventional liquid crystal display device may thus have a case where the liquid crystal display device can carry out the pause driving but cannot avoid having image sticking on a screen of a display panel.

The present invention is accomplished in view of the problem above. According to a display device in accordance with one aspect of the present invention, the pause driving can be carried out without causing image sticking on a display panel.

Solution to Problem

In order to achieve the object, a display device in accordance with one aspect of the present invention is a display device which includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned; a polarity designation signal output section outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and a drive circuit supplying the data signal to the each of the plurality of data lines in the each of the frames in the scanning period, the data signal having a polarity based on a polarity of a polarity designation signal supplied to the drive circuit in the each of the frames.

In order to achieve the object, a method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method including the steps of: (a) outputting a control signal which alternately designates a scanning period in which a whole region of a screen of the display panel is scanned and a pause period in which an at least partial region of the screen is not scanned; (b) outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and (c) (i) supplying the data signal to the each of the plurality of data lines in the each of the frames in the scanning period, the data signal having a polarity based on a polarity of a polarity designation signal supplied in the each of the frames and (ii) not supplying the data signal to the each of the plurality of data lines in the each of the frames in the pause period.

Advantageous Effects of Invention

A display device in accordance with one aspect of the present invention has an advantageous effect that the display device is capable of carrying out pause driving and does not have image sticking on a display panel.

DESCRIPTION OF EMBODIMENTS

The following description will discuss in detail an embodiment of the present invention with reference to drawings. In the description below, the same reference sign will be given to members having the same function and effect, and description on such members will not be repeated.

First Embodiment (Arrangement of Display System 1)

Figure 1:
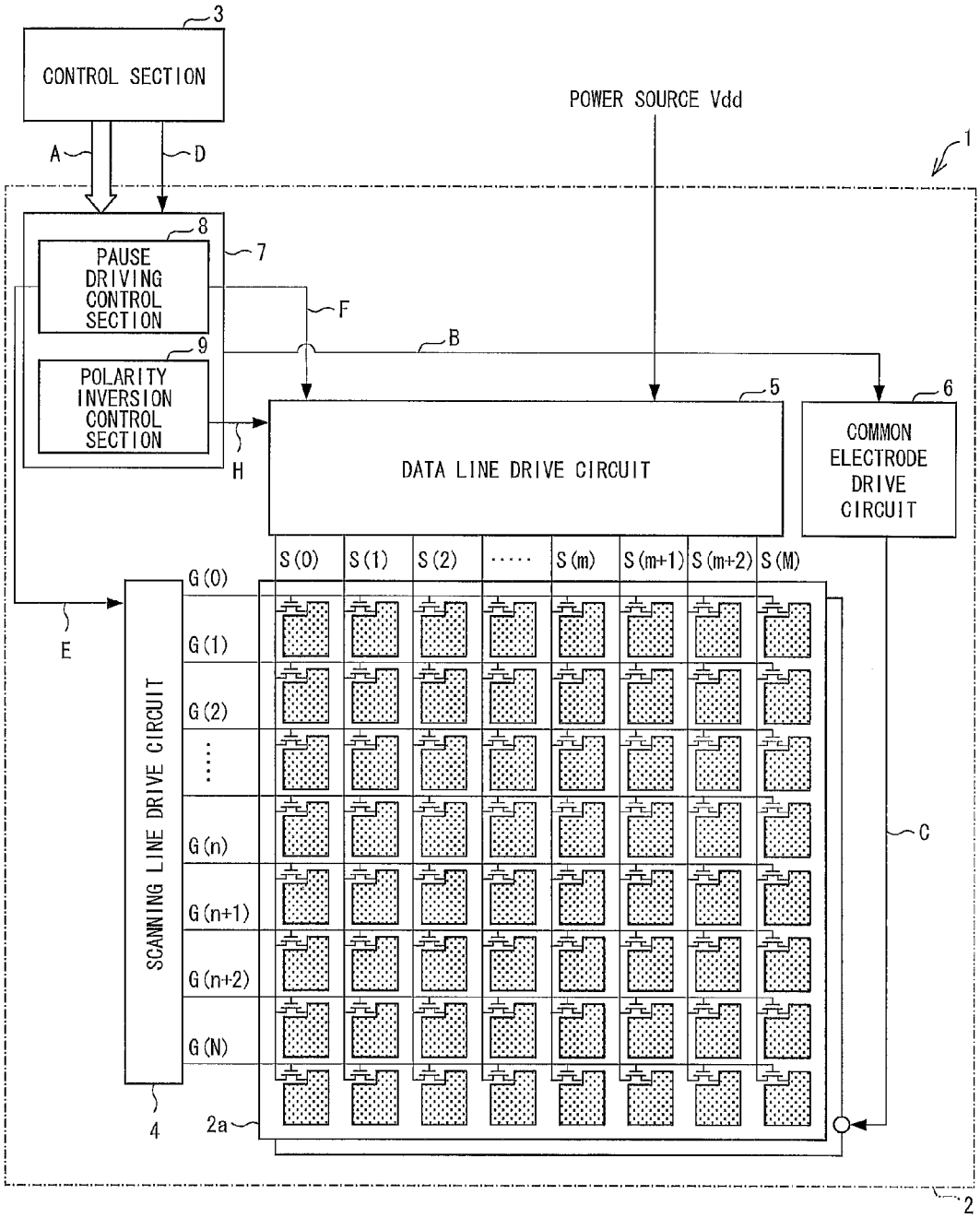
FIG. 1 is a block diagram illustrating a substantial arrangement of a display system in accordance with an embodiment of the present invention.

The following description will discuss, with reference to FIG. 1, an arrangement of a display system 1 in accordance with the present embodiment. FIG. 1 is a block diagram illustrating details of an arrangement of the display system 1 in accordance with the present embodiment. As illustrated in FIG. 1, the display system 1 includes a display device 2 and a control section 3. In the display system 1 of the present embodiment, the control section 3 outputs video via the display device 2 so that the video is displayed. Apart from video, the control section 3 is also capable of outputting, to the display device 2, given information such as a static image or a sign.

The display device 2 includes a display panel 2*a*, a scanning line drive circuit 4, a data line drive circuit 5 (a drive circuit), a common electrode drive circuit 6, and a timing control section 7. The timing control section 7 includes a pause driving control section 8 (a control signal output section) and a polarity inversion control section 9 (a polarity designation signal output section).

The display panel 2*a* includes a screen which includes a plurality of pixels arranged in matrix. The display panel 2*a* also includes N (N is a given integer) scanning lines G (gate lines) for scanning the screen sequentially on a line by line basis. The display panel 2*a* further includes M (M is a given integer) data lines S (source lines) for supplying data signals to pixels equivalent to one (1) row and included in a selected line. The scanning lines G and the data lines S intersect with each other. The plurality of pixels are provided separately near at respective intersections between the plurality of scanning lines G and the plurality of data lines S.

The display panel 2*a* further includes a liquid crystal layer (not shown). That is, the display device 2 is what is called a liquid crystal display device.

Figure 2:
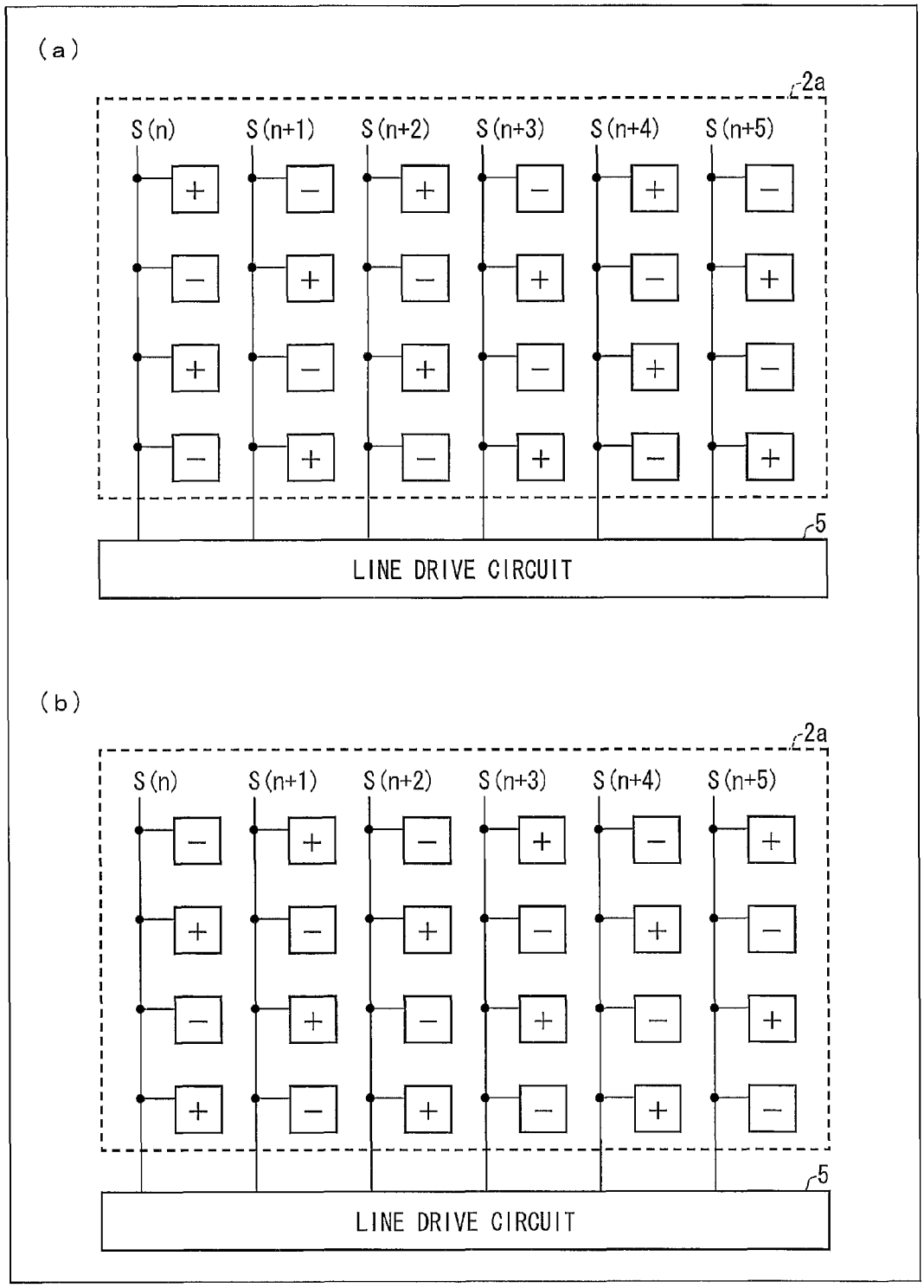
FIG. 2 is a view illustrating a display panel in a state where data signals are written by a 'dot inversion' polarity inversion method.

In FIG. 2, G(n) represents an n-th (n is an integer not smaller than one but not greater than N) scanning line G. For example, G(1), G(2), and G(3) represent first, second, and third scanning lines G, respectively. S(m) represents an m-th (m is an integer not smaller than one but not greater than M) data line S. For example, S(1), S(2), and S(3) represent first, second, and third data lines S, respectively.

The scanning line drive circuit 4, for example, scans the plurality of scanning lines G sequentially from top to bottom of the screen. At this time, the scanning line drive circuit 4 supplies, to each of the plurality of scanning lines G, a rectangular wave for bringing a switching element (pixel thin-film transistor (TFT)), which is provided in a pixel and connected to a pixel electrode, to an ON state. In this way, the scanning line drive circuit 4 causes pixels equivalent to one (1) row in the screen to be selected.

The data line drive circuit 5 calculates, on the basis of a video signal (arrow A) supplied from the control section 3, a value of a voltage to be supplied to each of the selected pixels equivalent to one (1) row, and supplies, to corresponding one of the plurality of data lines S, a voltage (data signal) having the calculated value. In this manner, the data line drive circuit 5 supplies image data to the pixels (pixel electrodes) provided on the selected one of the plurality of scanning line G.

The display device 2 includes a common electrode (not shown) provided for the plurality of pixels in the screen. The common electrode drive circuit 6 supplies the common electrode with a predetermined common voltage for driving the common electrode (arrow C), on the basis of a signal (arrow B) supplied from the timing control section 7.

The timing control section 7 supplies each of the circuits with a signal which serves as a reference for the circuits to operate in synchronization with each other, on the basis of the clock signal, the horizontal sync signal, and the vertical sync signal which are supplied from the control section 3. Specifically, the timing control section 7 supplies a gate start pulse signal GSP, a gate clock signal GCK, and a gate output enable signal GOE to the scanning line drive circuit 4 on the basis of the clock signal, the horizontal sync signal, and the vertical sync signal. The timing control section 7 supplies a source start pulse signal SSP, a source latch strobe signal SLS, and a source clock signal SCK to the data line drive circuit 5 on the basis of the clock signal, the horizontal sync signal, and the vertical sync signal.

The scanning line drive circuit 4 starts scanning the display panel 2*a* in response to the gate start pulse signal GSP received from the timing control section 7, and applies a selection voltage to the plurality of scanning lines G sequentially in accordance with the gate clock signal GCK, which is a signal that causes selection of a scanning line G to be shifted sequentially among the plurality of scanning lines G. The data line drive circuit 5 stores, in response to the source start pulse signal SSP received from the timing control section 7, supplied image data of each pixel in a register in accordance with the source clock signal SCK. After storing the image data, the data line drive circuit 5 writes the image data into a corresponding pixel electrode via a corresponding data line S of the display panel 2*a* in accordance with the next source latch strobe signal SLS. The image data is written into the pixel electrode by means of, for example, an analog amplifier included in the data line drive circuit 5.

Note that a voltage necessary for each circuit in the display system 1 to operate is supplied, for example, from a power supply circuit (not shown), which may be included in the control section 3. An example of the voltage necessary for each circuit in the display system 1 to operate is a power supply voltage Vdd which is supplied to the data line drive circuit 5.

(Pause Driving)

The display device 2 carries out what is called pause driving in order to reduce power consumption while the display device 2 operates. The following description will discuss the pause driving carried out by the display device 2.

In the display system 1, the control section 3 instructs the display device 2 to carry out the pause driving. At this time, the control section 3 supplies a control signal (designation signal) indicated by an arrow D to the timing control section 7. The control signal thus supplied from the outside of the display device 2 is received by the pause driving control section 8 in the timing control section 7. The control signal includes information indicative of the number of frames constituting a scanning period in which a whole region of the screen of the display panel 2*a* is scanned and information indicative of the number of frames constituting a pause period in which an at least partial region of the screen is not scanned. The at least partial region is hereinafter referred to as a pause region.

The pause driving control section 8 calculates, on the basis of the control signal received, the number of frames constituting a scanning period and the number of frames constituting a pause period. In this case, since the control signal includes said pieces of information respectively indicative of the number of frames constituting a scanning period and the number of frames constituting a pause period, the pause driving control section 8 calculates the number of frames constituting a scanning period and the number of frames constituting a pause period by simply employing, as the calculated numbers of the frames, the respective numbers indicated by the pieces of information.

The pause driving control section 8 generates a control signal that alternately designates a scanning period constituted by the calculated number of frames and a pause period constituted by the calculated number of frames, and supplies the control signal to the scanning line drive circuit 4 and the data line drive circuit 5 (arrows E and F). At this time, for example, the pause driving control section 8 supplies a control signal that has an H value in each frame in a scanning period and an L value in each frame in a pause period. The pause driving of the display device 2 can thus be controlled from the outside of the display system 1.

The scanning line drive circuit 4 and the data line drive circuit 5 specify a scanning period and a pause period on the basis of the control signal received. In each frame in the scanning period, the scanning line drive circuit 4 supplies a scanning signal to each of the plurality of scanning lines G in the entire screen of the display panel 2*a*, and the data line drive circuit 5 supplies a data signal to each of the plurality of data lines S in the entire screen of the display panel 2*a*. On the other hand, in each frame in the pause period, the scanning line drive circuit 4 supplies no scanning signal to each scanning line G in the pause region. Note that the data line drive circuit 5 does not have to supply any data signal to each data line S in the pause region.

The processes described above allow reducing at least power consumption required for supplying a scanning signal to the pause region in a pause period. This yields a significant reduction in power consumption of the display device 2 in a pause period as compared with a drive period. This allows the display device in accordance with one aspect of the present invention to operate with electric power lower than that required in a display device that does not carry out pause driving. Further, it is preferable that no data signal be supplied to each data line S in the pause region in a pause period. This allows power consumption required for supplying a data signal to the pause region in a pause period to be reduced as well. Consequently, the power consumption in the display device 2 is further reduced. Note that a data signal for black display may be supplied to each data line S in the pause region.

In each pause period, a TFT in a pixel is turned off, so that a voltage applied to liquid crystal of the pixel in a frame immediately preceding the pause period is maintained as it is. Accordingly, an image which has been displayed is also maintained into each pause period. That is, the pause driving is suitable for a case of displaying a video including a region in which displayed content does not change over a certain number of frames.

(Calculation of Frame Count Based on Video Signal)

The pause driving control section 8 is capable of calculating, on the basis of the video signal indicated by the arrow A, the number of frames constituting a scanning period and the number of frames constituting a pause period. In this case, the control signal indicated by the arrow D is not supplied from the control section 3 to the timing control section 7. The pause driving control section 8 analyzes content of the received video signal to thereby calculate the number of frames constituting a scanning period and the number of frames constituting a pause period, in accordance with the video represented by the video signal. As such, in a case where the content of the video represented by the video signal changes, the number of frames calculated also changes. In this way, the pause driving control section 8 generates a control signal that designates a scanning period constituted by an optimum number of frames according to the video signal and a pause period constituted by an optimum number of frames according to the video signal. This allows the display device 2 to carry out optimum pause driving according to the video signal.

(Calculation of Frame Count According to Information in Memory)

The pause driving control section 8 is capable of calculating, on the basis of information stored in a memory (not shown), the number of frames constituting a scanning period and the number of frames constituting a pause period. In this case, the control signal indicated by the arrow D is not supplied from the control section 3 to the timing control section 7. In addition, the pause driving control section 8 does not have to analyze the video signal.

In the memory, information indicative of the number of frames constituting a scanning period and information indicative of the number of frames constituting a pause period are stored in advance. The pause driving control section 8 reads out these pieces of information from the memory, and calculates the number of frames constituting a scanning period and the number of frames constituting a pause period by simply employing, as the calculated numbers of the frames, the respective numbers indicted by the pieces of information.

(Reverse Polarity Driving)

The display device 2 carries out what is called reverse polarity driving in order to prevent occurrence of flicker and image sticking on the screen while the display device 2 operates. The following description will discuss the reverse polarity driving.

In the display device 2, the pause driving control section 8 in the timing control section 7 supplies the data line drive circuit 5 with a polarity designation signal (hereinafter referred to as a POL signal) which designates a polarity of a data signal supplied to each of the plurality of data lines (arrow H). In the present embodiment, the polarity inversion control section 9 outputs the POL signal while controlling a polarity of the POL signal in accordance with whether the current frame is included in a scanning period or in a pause period. Specifically, the polarity inversion control section 9 outputs the POL signal in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period.

In each frame in a scanning period, the data line drive circuit 5 supplies, to each of the plurality of data lines S, a data signal having a polarity that is based on the polarity of the POL signal supplied to the data line drive circuit 5 in the each frame. For example, in a case where the POL signal has a positive (+) polarity, the data line drive circuit 5 supplies each of the plurality of data lines S with a data signal that also has a positive (+) polarity. On the other hand, in a case where the POL signal has a negative (−) polarity, the data line drive circuit 5 supplies each of the plurality of data lines S with a data signal that also has a negative (−) polarity.

In each scanning period, the POL signals in the respective frames have a completely identical polarity. Accordingly, the polarities of the data signals outputted by the data line drive circuit 5 in the respective frames are similarly also identical, without varying every frame. Consequently, in the display device 2, the voltages applied to liquid crystal in the respective frames in each scanning period have a completely identical polarity.

Note that the polarity of the POL signal and the polarity of the data signal supplied to each of the plurality of data lines S are not necessarily identical to each other. For example, in a case where the reverse polarity driving is carried out in accordance with 'dot inversion method' or 'source inversion method' (each described later), the polarity of the data line is reversed every data line S in a frame. As such, the display device 2 is also capable of carrying out a process in which, in a case where the POL signal has a positive polarity in a frame, a data signal supplied to a data line S(0) in the frame has a positive polarity whereas a data signal supplied to a data signal S(1) in the frame has a negative polarity. In the display device 2, to 'supply each of the plurality of data lines S with a data signal having a polarity based on the polarity of the POL signal' fundamentally means to 'cause the polarity of the data signal supplied to the each of the plurality of data lines S to be reversed every time the polarity of the POL signal is reversed'.

(Concrete Examples of Polarity Inversion Method)

Figure 3:
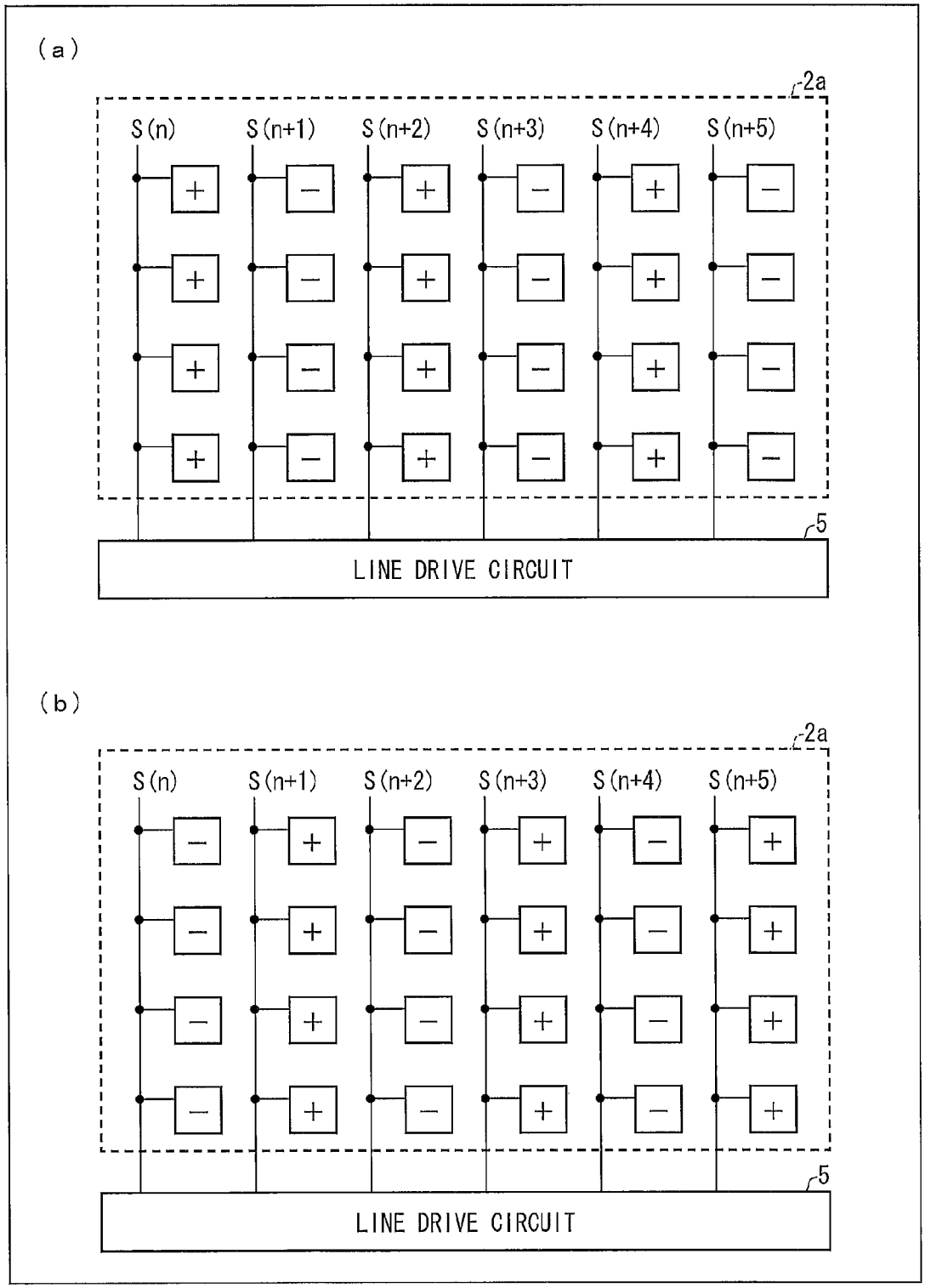
FIG. 3 is a view illustrating a display panel in a state where data signals are written by a 'source inversion' polarity inversion method.

The following description will concretely discuss a polarity inversion method with reference to FIGS. 2 and 3. In the following description, each of a 'dot inversion' polarity inversion method and a 'source inversion' polarity inversion method will be described by using pixels arranged in six pixel rows×four pixel columns among the plurality of pixels provided in the display panel 2*a*.

FIG. 2 is a view illustrating the display panel 2*a* in a state where source signals are written by the 'dot inversion' polarity inversion method. FIG. 3 is a view illustrating the display panel 2*a* in a state where source signals are written by the 'source inversion' polarity inversion method.

In each of FIGS. 2 and 3, a pixel indicated with '+' represents a state in which positive polarity data is written into the pixel, and a pixel indicated with '−' represents a state in which negative polarity data is written into the pixel.

In each of FIGS. 2 and 3, polarities of source signals for the respective pixels are reversed between (a) and (b).

(Spatial Cycle of Polarity Inversion)

As illustrated in FIG. 2, according to the 'dot inversion' polarity inversion method, pixels in each pixel row are arranged so that polarities of source signals for the respective pixels in the each pixel row are reversed every pixel along spatial directions (a pixel row direction and a pixel column direction) of the display panel, specifically, '+, −, +, −' or '−, +, −, +'.

As illustrated in FIG. 3, according to the 'source inversion' polarity inversion method, pixels in each pixel row are arranged so that source signals for the respective pixels in the each pixel row have an identical polarity, specifically, '+, +, +, +' or '−, −, −, −', and pixels in each pixel column are arranged so that polarities of source signals for the respective pixels in the each pixel column are reversed every pixel, specifically, '+, −, +, −' or '−, +, −, +'.

(Temporal Cycle of Polarity Inversion)

As illustrated in FIG. 2, in a case where 'dot inversion' is employed as a spatial cycle of the polarity inversion, employment of 'one-frame inversion' as a temporal cycle of the polarity inversion causes the polarity of each pixel in the display panel 2*a* to be reversed every frame so that, for example, the display panel 2*a* sequentially undergoes the states of '(a) of FIG. 2, (b) of FIG. 2, (a) of FIG. 2, (b) of FIG. 2, . . . '. In the case where 'dot inversion' is employed, employment of 'two-frame inversion' as a temporal cycle of the polarity inversion causes the polarity of each pixel in the display panel 2*a* to be reversed every two frames so that, for example, the display panel 2*a* sequentially undergoes the states of '(a) of FIG. 2, (a) of FIG. 2, (b) of FIG. 2, (b) of FIG. 2, . . . '.

Similarly, as illustrated in FIG. 3, in a case where 'source inversion' is employed as a spatial cycle of the polarity inversion, employment of 'one-frame inversion' as a temporal cycle of the polarity inversion causes the polarity of each pixel in the display panel 2*a* to be reversed every frame so that, for example, the display panel 2*a* sequentially undergoes the states of '(a) of FIG. 3, (b) of FIG. 3, (a) of FIG. 3, (b) of FIG. 3, . . . '. In the case where 'source inversion' is employed, employment of 'two-frame inversion' as a temporal cycle of the polarity inversion causes the polarity of each pixel in the display panel 2*a* to be reversed every two frames so that, for example, the display panel 2*a* sequentially undergoes the states of '(a) of FIG. 3, (a) of FIG. 3, (b) of FIG. 3, (b) of FIG. 3, . . . '.

(Combination of Pause Driving and Reverse Polarity Driving)

The display device 2 of the present embodiment carries out the pause driving and the reverse polarity driving simultaneously. This point will be discussed in detail below with reference to FIGS. 4 and 5.

Figure 4:
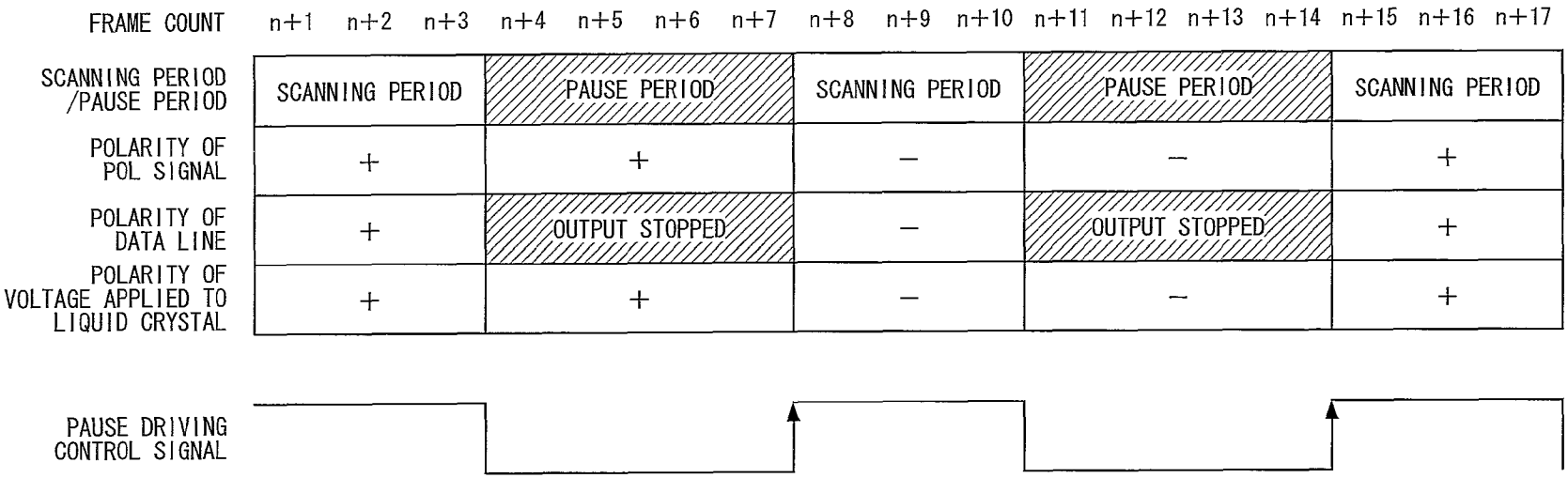
FIG. 4 is a view illustrating an example of a polarity of a voltage applied to liquid crystal in each frame when a display device in accordance with an embodiment of the present invention carries out pause driving.

FIG. 4 is a view illustrating an example of a polarity of a voltage applied to liquid crystal in each frame when the display device 2 of the present embodiment carries out the pause driving. In an example illustrated in FIG. 4, the number of frames constituting a scanning signal is three, and the number of frames constituting a pause period is four. Note that there is no limitation on the number of frames constituting a scanning period and the number of frames constituting a pause period.

In the present embodiment, the pause driving control section 8 maintains, without reversing, the polarity of the POL signal during each scanning period. Further, the pause driving control section 8 reverses the polarity of the POL signal every scanning period. On the other hand, during each pause period, the pause driving control section 8 keeps outputting a POL signal that the pause driving control section 8 outputted last in a scanning period immediately preceding the each pause period. That is, at a timing when switching from a scanning period to a pause period is carried out, the pause driving control section 8 maintains, without reversing, the polarity of the POL signal. On the other hand, at a timing when switching from a pause period to a scanning period is carried out, the polarity of the POL signal is reversed.

According to the above processes, in the display device 2 of the present embodiment, the polarities of the POL signals in the respective frames in each scanning period are identical to each other, without being reversed every frame. In the example illustrated in FIG. 4, the POL signal has a positive polarity in an (n+1)-th frame (n is a natural number) through an (n+3)-th frame in the scanning period. Note, here, that the polarity of the POL signal is reversed every scanning period. In the example illustrated in FIG. 4, the POL signal has a positive polarity in the first scanning period, a negative polarity in an (n+8)-th frame through an (n+10)-th frame in the subsequent scanning period, and a positive polarity in an (n+15)-th frame through an (n+17)-th frame in the further subsequent scanning period.

On the other hand, the polarity of the POL signal in each pause period is identical to the polarity of the POL signal in a scanning period immediately preceding the each pause period. The polarities of the POL signals in the respective frames in each pause period are identical to each other, without being reversed every frame. Accordingly, in the example illustrated in FIG. 4, the POL signal has a positive polarity in an (n+4)-th frame through an (n+7)-th frame in the first pause period, and a negative polarity in an (n+11)-th frame through an (n+14)-th frame in the subsequent pause period.

As described above, in the display device 2, a data signal having a polarity based on the polarity of the POL signal is supplied to each of the plurality of data lines S in each frame in each scanning signal. In the example illustrated in FIG. 4, when the POL signal has a positive polarity, a data signal that also has a positive polarity is supplied to each of the plurality of data lines S. On the other hand, when the POL signal has a negative polarity, a data signal that also has a negative polarity is supplied to each of the plurality of data lines S. Accordingly, in each frame in each scanning period, the polarity of the POL signal and the polarity of each of the plurality of data lines S are identical to each other.

In the display device 2, a voltage applied to liquid crystal is maintained in each pixel in each pause period which voltage has a polarity identical to that of each of the plurality of data lines S in the last frame in a scanning period immediately preceding the each pause period. This is due to an effect of a capacitance component which is present in each pixel. Accordingly, in the display device 2 of the present embodiment, the polarity of the voltage applied to liquid crystal and retained in each pixel in each pause period is reversed every pause period. For example, in the example shown in FIG. 4, the polarity of the voltage applied to liquid crystal is always positive during the first pause period, and always negative during the subsequent pause period.

As described above, in the display device 2 of the present embodiment, the voltage applied to liquid crystal has an identical polarity between each scanning period and a pause period immediately subsequent to the each scanning period, as illustrated in FIG. 4. Further, every time switching from a pause period to a scanning period is carried out, the polarity of the voltage applied to liquid crystal is reversed. Accordingly, even when the display device 2 continues operating, the polarity of the voltage applied to liquid crystal in each pixel is well balanced, without being positive more often than negative, and vice versa. This prevents imbalance in electric charge in liquid crystal and, accordingly, prevents occurrence of image sticking on the display panel.

As described above, the display device 2 in accordance with the present embodiment has an advantage that the display device 2 is capable of carrying out the pause driving and does not have image sticking on the display panel. Further, since the polarity inversion cycle is every plurality of frames, the power consumption of the display device 2 can be reduced further.

(Example of Polarity Inversion Control)

The polarity inversion control section 9 may control the inversion of the polarity of the POL signal in accordance with the control signal which designates a scanning period and a pause period. Specifically, the polarity inversion control section 9 causes the polarity of the POL signal to be reversed in synchronization with a timing when the value of the control signal changes from an L value to an H value. As described above, a period during which the control signal has an H value is a scanning period, and a period during which the control signal has an L value is a pause period. Accordingly, by reversing the polarity of the POL signal at a timing when the value of the control signal changes from an L value to an H value, the polarity of the POL signal can be reversed at a timing when switching from a pause period to a scanning period is carried out.

According to a control method as described above, it is not necessary to carry out precise control of the polarity of the POL signal in accordance with the difference between a scanning period and a pause period. This eliminates the need for a logical operation circuit for determining the polarity of the POL signal.

(Another Example of Polarity Inversion Control)

The polarity inversion control section 9 may cause the output of the POL signal to be stopped in a pause period. Specifically, the polarity inversion control section 9 causes the output to have a high impedance. In a case where such a control is carried out, the timing control section 7 needs a logic circuit which latches (stores) a logical value indicative of the polarity of the POL signal in a frame immediately preceding the pause period. Further, a NOT circuit connected to the logic circuit is also needed by the timing control section 7.

At the time of reversing the polarity of the POL signal, the logical value stored in the logic circuit and indicative of the polarity of the POL signal is supplied to the polarity inversion control section 9 via the NOT circuit, at a timing when switching from a scanning period to a pause period is carried out. This causes the logical value to be reversed and supplied to the polarity inversion control section 9. The polarity inversion control section 9 outputs a POL signal having a polarity that is based on the logical value thus supplied. This allows the polarity inversion control section 9 to reverse the polarity of the POL signal every time switching from a pause period to a scanning period is carried out.

In a case where this control method is carried out, there is no need of a periodic signal generation circuit for generating a POL having a polarity that is periodically reversed.

(Pixels of Display Panel 2*a*)

Next, the following description will discuss pixels included in the display panel 2*a* of the display device 2 in accordance with the first embodiment or the second embodiment.

The display device 2 of the present embodiment employs, as the TFT of each of the plurality of pixels included in the display panel 2*a*, a TFT in which a semiconductor layer is constituted by what is called an oxide semiconductor. Specifically, the display device 2 of the present embodiment employs a TFT in which a semiconductor layer is constituted by, as the oxide semiconductor, what is called IGZO ($InGaZnO_x$) which is an oxide constituted by indium (In), gallium (Ga), and zinc (Zn). Advantages of a TFT in which an oxide semiconductor is used will be described below.

(TFT Characteristic)

Figure 5:
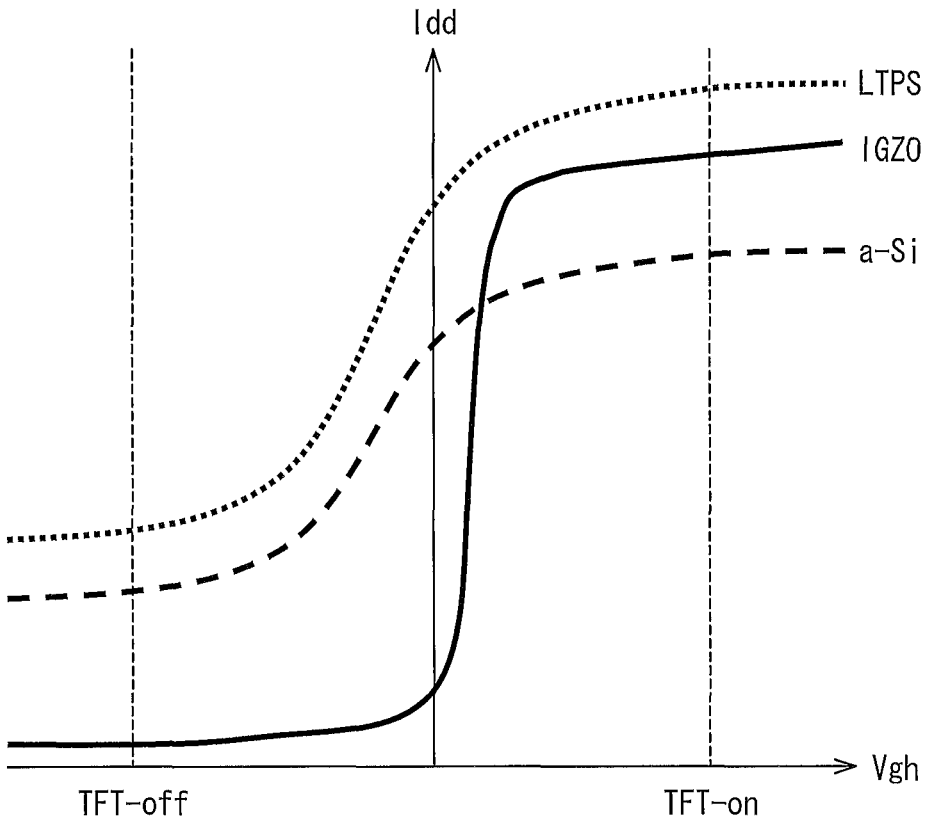
FIG. 5 is a view showing characteristics of various TFTs including a TFT in which an oxide semiconductor is used.

FIG. 5 is a view showing characteristics of various TFTs including a TFT in which an oxide semiconductor is used. FIG. 5 shows a characteristic of the TFT in which the oxide semiconductor is used, a characteristic of a TFT in which a-Si (amorphous silicon) is used, and a characteristic of a TFT in which LTPS (Low Temperature Poly Silicon) is used.

In FIG. 5, a horizontal axis (Vgh) indicates a value of an ON voltage supplied to a gate of each of the TFTs, and a vertical axis (Id) indicates an amount of an electric current between a source and a drain of each of the TFTs.

Figure 6:
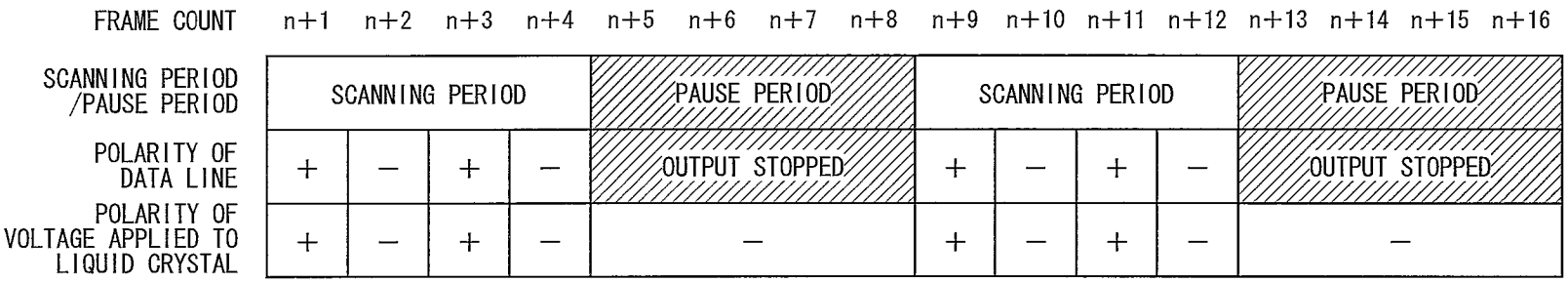
FIG. 6 is a view illustrating a polarity of a voltage applied to liquid crystal in each frame when a conventional liquid crystal display device carries out pause driving.

Specifically, a period indicated as 'TFT-on' in FIG. 6 represents a period in which each of the TFTs is in an ON state in accordance with the value of the ON voltage, and a period indicated as 'TFT-off' in FIG. 6 represents a period in which each of the TFTs is in an OFF state in accordance with the value of the ON voltage.

As shown in FIG. 5, the TFT in which the oxide semiconductor is used has a higher electron mobility when the TFT is in the ON state, as compared with the TFT in which a-Si is used.

Though not shown, specifically, the TFT in which a-Si is used has an electric current Id of 1 uA when the TFT has been turned on, whereas the TFT in which the oxide semiconductor has an electric current Id of approximately 20 uA to 50 uA when the TFT has been turned on.

This shows that the electron mobility at the time of an ON state is 20 to 50 times higher in the TFT in which the oxide semiconductor is used than in the TFT in which a-Si is used, and the TFT in which the oxide semiconductor is used thus has an excellent ON characteristic.

As previously described, the display device 2 of the present embodiment employs, for each pixel, the TFT in which the oxide semiconductor as described above is used. Accordingly, the display device 2 of the present embodiment can drive each pixel by use of the TFT which has an excellent ON characteristic and therefore is smaller in size. This allows reducing a ratio of an area occupied by the TFT in each pixel. That is, it becomes possible to increase an aperture ratio in each pixel, thereby increasing optical transmittance of backlight. This allows employing a backlight device with low power consumption as well as suppressing luminance of the backlight device. Consequently, a reduction in power consumption is achieved.

Further, since the TFT has the excellent ON characteristic, time required to write a data signal into each pixel can be shortened. This allows easily increasing a refresh rate of the display panel 2*a*.

In addition, as shown in FIG. 5, the TFT in which the oxide semiconductor is used has a less leak current at the time of an OFF state, as compared with the TFT in which a-Si is used.

Though not shown, specifically, the TFT in which a-Si is used has an electric current Id of 10 pA when the TFT has been turned off, whereas the TFT in which the oxide semiconductor is used has an electric current Id of approximately 0.1 pA when the TFT has been turned off.

This shows that the leak current at the time of an OFF state of the TFT in which the oxide semiconductor is used is approximately 1/100 of the leak current at the time of an OFF state of the TFT in which a-Si is used. The TFT in which the oxide semiconductor is used thus has an excellent OFF characteristic with almost no leak current.

Accordingly, the display device 2 of the present embodiment has an excellent OFF characteristic of the TFT, and can therefore maintain, for a long time, a state in which a data signal is written into each of the plurality of pixels of the display panel 2*a*. This allows the display device 2 to carry out the pause driving while maintaining a high display quality, and also to take a longer pause period.

The present invention is not limited to the above-described embodiments. A person skilled in the art can make various modifications of the present invention within the scope of the claims. In other words, new embodiment can be derived from a combination of technical means appropriately modified within the scope of the claims.

(Control in Accordance with Odd Number or Even Number)

When the pause driving control section 8 has received a designation signal that designates an odd number as the number of frames constituting a scanning period, the pause driving control section 8 controls the polarity of the POL signal in accordance with either the method of the first embodiment or the method of the modified example of the first embodiment. On the other hand, when the pause driving control section 8 has received a designation signal that designates an even number as the number of frames constituting a scanning period, the pause driving control section 8 controls the polarity of the POL signal in accordance with either the method of the second embodiment or the method of the modified example of the second embodiment. Performing these controls allows the display device 2 to both carry out the pause driving regardless of the number of frames constituting a scanning period, and have no image sticking on a display panel.

(Polarity Inversion Cycle of POL Signal)

It is preferable that the polarity inversion control section 9 output the POL signal while causing the polarity of the POL signal to be reversed every frame in each scanning period. This causes the polarity of the data signal to be reversed every frame in each scanning period. This enables a further reduction in influence of flicker, so that the display quality can be further enhanced.

The polarity inversion control section 9 may output the polarity designation signal while causing the polarity of the polarity designation signal to be reversed every x (x is a natural number of two or more) frames in each scanning period. Here, the number of frames constituting a scanning period is l (l is a natural number of two or more) where l can be divided by x. Then, for example, a relation such as x=2 and l=6 holds. This allows a reduction in the polarity inversion cycle of the data signal and, accordingly, allows a reduction in power consumption of the display device 2.

The present invention is not limited to the above-described embodiments but allows various modifications within the scope of the claims. In other words, any embodiment obtained by combining technical means appropriately modified within the scope of the claims will also be included in the technical scope of the present invention.

CONCLUSION

In order to achieve the object, a display device in accordance with one aspect of the present invention is a display device which includes: a display panel including a plurality of scanning lines, a plurality of data lines intersecting with the plurality of scanning lines, and a plurality of pixels provided separately near at respective intersections of the plurality of scanning lines and the plurality of data lines; a control signal output section outputting a control signal which alternately designates a scanning period in which a whole region of a screen of the display panel is scanned and a pause period in which an at least partial region of the screen is not scanned; a polarity designation signal output section outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and a drive circuit supplying the data signal to the each of the plurality of data lines in the each of the frames in the scanning period, the data signal having a polarity based on a polarity of a polarity designation signal supplied to the drive circuit in the each of the frames.

According to the arrangement, the display device in accordance with one aspect of the present invention carries out what is called pause driving. Specifically, the display device scans the whole region of the screen of the display panel in each of the frames in each scanning period, but does not scan the at least partial region of the screen in each of the frames in each pause period. At this time, the power consumption of the display device in each pause period is significantly reduced as compared with that in each scanning period. Accordingly, the display device in accordance with one aspect of the present invention can operate with electric power lower than that required in a display device that does not carry out the pause driving.

The polarity designation signals in the respective frames in each scanning period always have an identical polarity, and the polarity is reversed every scanning period. In each of the frames of each scanning period, the drive circuit supplies, to each of the plurality of data lines, a data signal having a polarity that is based on the polarity of the polarity designation signal. Accordingly, the data signals supplied to each data line in the respective frames in each scanning period always have an identical polarity, and the polarity is reversed every scanning period.

In each pixel in each scanning period, a voltage having a polarity identical to that of the data signal outputted in each frame is applied to a corresponding pixel electrode. Accordingly, the voltages applied to the pixel electrode in the respective frames in each scanning period always have an identical polarity, and the polarity is reversed every scanning period.

On the other hand, a voltage is retained in the pixel electrode in each pixel in each pause period which voltage has a polarity identical to that of the data signal supplied to a corresponding one of the plurality of data lines in the last frame in a scanning period immediately preceding the each pause period. As described above, the data signals in the respective frames in each scanning period always have an identical polarity, and the polarity is reversed every scanning period. As a result, the polarity of the polarity designation signal in the last frame in each scanning period is reversed every scanning period, in other words, at any timing that is immediately before a pause period. Accordingly, the polarity of the pixel electrode retained in each pixel in each pause period is reversed every pause period.

According to these, in the display device in accordance with one aspect of the present invention, the polarity of the pixel electrode is identical between a scanning period and a pause period immediately subsequent to the scanning period. Further, every time switching from a pause period to a scanning period is carried out, the polarity of the pixel electrode is reversed. This prevents the polarity of the pixel electrode in each pixel from becoming positive more often than negative, and vice versa, even when the display device continues operating.

As described above, the display device in accordance with one aspect of the present invention has the advantageous effect that the display device is capable of carrying out the pause driving and does not have image sticking on the display panel. Further, since the polarity inversion cycle is every plurality of frames, the power consumption of the display device 2 can be reduced further.

In order to achieve the object, a method in accordance with one aspect of the present invention for driving a display device is a method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method including the steps of: (a) outputting a control signal which alternately designates a scanning period in which a whole region of a screen of the display panel is scanned and a pause period in which an at least partial region of the screen is not scanned; (b) outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and (c) (i) supplying the data signal to the each of the plurality of data lines in the each of the frames in the scanning period, the data signal having a polarity based on a polarity of a polarity designation signal supplied in the each of the frames and (ii) not supplying the data signal to the each of the plurality of data lines in the each of the frames in the pause period.

The arrangement brings about an advantageous effect similar to the advantageous effect brought about by the display device in accordance with one aspect of the present invention.

The display device in accordance with one aspect of the present invention is preferably arranged such that each of the plurality of pixels includes a TFT which includes a semiconductor layer constituted by an oxide semiconductor. Specifically, the oxide semiconductor is preferably IGZO.

Accordingly to the arrangement, the display device has an excellent OFF characteristic of the TFT of each of the plurality of pixels, and can therefore maintain, for a long time, a state in which a data signal is written into each of the plurality of pixels of the display panel. This allows the display device to carry out the pause driving while maintaining a high display quality, and also to take a longer pause period.

The display device in accordance with one aspect of the present invention is preferably arranged such that the display device is a liquid crystal display device.

The arrangement allows providing a liquid crystal display device which is capable of carrying out the pause driving and does not have image sticking on a display panel.

INDUSTRIAL APPLICABILITY

The display device of the present invention can be utilized as a wide variety of display devices, such as a liquid crystal display device, which carry out the pause driving and the reverse polarity driving simultaneously.

REFERENCE SIGNS LIST

1: DISPLAY SYSTEM
2: DISPLAY DEVICE
2A: DISPLAY PANEL
3: CONTROL SECTION
4: SCANNING LINE DRIVE CIRCUIT
5: DATA LINE DRIVE CIRCUIT (DRIVE CIRCUIT)
6: COMMON ELECTRODE DRIVE CIRCUIT
7: TIMING CONTROL SECTION
8: PAUSE DRIVING CONTROL SECTION (CONTROL SECTION)
9: POLARITY INVERSION CONTROL SECTION (POLARITY DESIGNATION SIGNAL OUTPUT SECTION)

The invention claimed is:

1. A display device comprising:

a display panel including a plurality of scanning lines, a plurality of data lines intersecting with the plurality of scanning lines, and a plurality of pixels provided separately near at respective intersections of the plurality of scanning lines and the plurality of data lines;

a control signal output section outputting a control signal which alternately designates a scanning period in which a whole region of a screen of the display panel is scanned and a pause period in which an at least partial region of the screen is not scanned;

a polarity designation signal output section outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and a drive circuit supplying the data signal to the each of the plurality of data lines in the each of the frames in the scanning period, the data signal having a polarity based on a polarity of a polarity designation signal supplied to the drive circuit in the each of the frames.

2. The display device as set forth in claim 1, wherein each of the plurality of pixels includes a TFT which includes a semiconductor layer constituted by an oxide semiconductor.

3. The display device as set forth in claim 2, wherein the oxide semiconductor is IGZO.

4. The display device as set forth in claim 1, wherein the display device is a liquid crystal display device.

5. A method for driving a display device, said display device including a display panel including a plurality of scanning lines, a plurality of data lines intersecting with the plurality of scanning lines, and a plurality of pixels provided separately near at respective intersections of the plurality of scanning lines and the plurality of data lines, said method comprising the steps of:

(a) outputting a control signal which alternately designates a scanning period in which a whole region of a screen of the display panel is scanned and a pause period in which an at least partial region of the screen is not scanned;

(b) outputting a polarity designation signal, which designates a polarity of a data signal supplied to each of the plurality of data lines, in such a manner that (i) polarity designation signals having an identical polarity are outputted in respective frames in the scanning period, (ii) the polarity of the polarity designation signals is reversed every scanning period, and (iii) a polarity designation signal outputted in each of frames in the pause period has a polarity identical to that of a polarity designation signal outputted in a scanning period immediately before the pause period; and (c) (i) supplying the data signal to the each of the plurality of data lines in the each of the frames in the scanning period, the data signal having a polarity based on a polarity of a polarity designation signal supplied in the each of the frames and (ii) not supplying the data signal to the each of the plurality of data lines in the each of the frames in the pause period.

* * * * *